US005097551A

United States Patent [19]

Smith

[11] Patent Number: 5,097,551

[45] Date of Patent: Mar. 24, 1992

[54] SKELETAL SUPPORT PILLOW

[76] Inventor: Jason D. Smith, 6253 W. Port Ave., Milwaukee, Wis. 53223

[21] Appl. No.: 703,019

[22] Filed: May 20, 1991

[51] Int. Cl.[5] ..... A47G 9/00

[52] U.S. Cl. ..... 5/652

[58] Field of Search ..... 5/431, 436, 448, 437, 5/443, 434; D6/601

[56] References Cited

U.S. PATENT DOCUMENTS

| | | | |
|---|---|---|---|
| 2,720,660 | 10/1955 | Smith | 5/434 |
| 3,838,205 | 2/1976 | Spann | 5/431 |
| 4,173,048 | 11/1979 | Varaney | 5/436 |
| 4,624,021 | 11/1986 | Hofstetter | 5/431 |
| 4,901,384 | 2/1990 | Eary | 5/431 |

*Primary Examiner*—Alexander Grosz

*Attorney, Agent, or Firm*—Fuller, Ryan & Hohenfeldt

[57] ABSTRACT

A skeletal support pillow conforming to the bodily skeletal dimensions of a user is provided which is dimensioned according to the bodily measurements of the user. The pillow includes a head support pillow section having a thickness approximately equal to the long leg of the right triangle whose hypotenuse lies between the acromial clavicular joint and the ipsilateral angle of the user's jaw. An arm tunnel/bridge section is attached at one side to the base of the head support pillow section, the tunnel having a diameter slightly greater than the maximum diameter of the user's upper arm. A body support section is attached to the opposite side of the arm tunnel/bridge section. The body support section has an upper body support portion having a thickness approximately equal to the distance between opposite auxillary folds of the user's body, and a lower limb support section approximately equal in thickness to the distance between the user's greater trochanter and the contralateral anterior superior iliac spine. The upper body support section has a width approximately equal to the distance between the user's anterior chest and elbow with, with arm extended, and the lower limb supporting section has a width approximately equal to the length of the user's femur.

4 Claims, 2 Drawing Sheets

SKELETAL SUPPORT PILLOW

FIELD OF THE INVENTION

This invention relates to pillows and more particularly, to custom designed pillows for supporting a person reclining on the side.

BACKGROUND

Persons who have suffered a trauma such as an accident or who have undergone surgical bone implants or artificial joint surgery often have difficulty in assuming a sleeping position which does not apply pressure to the surgical incision, or torch to the surgical implants and traumatized body parts. Underlying skeletal structures are protected by virtue of the sleeping (resting) position. Many such patients therefore sleep in a chair because of the technical problems associated with torch and pressure while attempting to sleep on the back or stomach A need has existed for a pillow device which will permit the side sleeping that significantly reduces the torch and pressures that inhibit the healing process. An effective resting period will shorten the healing time, decrease morbidity, decrease medical expenses and, return the patient to an active independent status more readily.

Various proposals for supporting the body of a user during sleep have been heretofore proposed. See, for example, U.S. Pat. No. 4,624,021, issued to Hofstetter on Nov. 25, 1986. In this patent a cushion-like support is suggested which is placed between the knees of the user who sleeps or rests on his side. A different device is shown in U.S. Pat. No. 4,901,384, issued Feb. 20, 1992 to Eary. In the pillow suggested therein, various attached together cushion sections of differing thicknesses are assembled to support a reclining user in a fixed position. That design, however, calls for supporting of both feet of the user in an elevated position.

While these and other examples of pillows and cushions enable a user to remain in one or more positions with varying degrees of comfort, there are no currently marketed or available pillows which are custom designed to fit the skeletal dimensions of an individual user to thus provide optimum support for the user based on his or her bodily dimensions. Thus, a need has continued to exist for an improved pillow especially adapted to situations in which proper rest is critical but difficult.

SUMMARY OF THE INVENTION

It is a principle object of the present invention to provide an improved body pillow custom fitted to the user's individual body dimensions.

It is a further object to provide such a pillow in which a head support is connected to the body pillow by means of a tunnel provided for passage of an arm and which provides a cut-out for the user's shoulders.

A further object is to provide a body pillow which, due to its dimensions comfortably supports the components of the user's body (particularly the axial skeleton, one arm together with ipsilateral leg, knee and ankle) in a physiologically neutral position.

It is yet another object of the invention to provide a body pillow for a user to recline in a side sleeping position while supporting body parts that may be injured or traumatized.

Briefly summarized, a skeletal support pillow conforming to the bodily skeletal dimensions of a user is provided which is dimensioned according to the bodily measurements of the user. The pillow includes a head support pillow section having a thickness approximately equal to the distance between the acromial clavicular joint to the ipsilateral angle of the jaw of the user. An arm tunnel/bridge section is attached at one side to the base of the head support pillow section, the tunnel having a diameter slightly greater than the maximum diameter of the user's upper arm. A body support section is attached to the opposite side of the arm tunnel/bridge section The body support section has an upper body support portion having a thickness approximately equal to the distance between opposite axillary folds of the user's body, and a lower limb support section approximately equal in thickness to the distance between the user's greater trochanter and the contralateral anterior superior iliac spine The upper body support section has a width approximately equal to the distance between the user's anterior chest and elbow with arm extended, and the lower limb supporting section has a width approximately equal to the length of the user's femur.

The support pillow according to the invention is configured such that the width of the body support section is centrally widened and tapered toward the narrower distal end and arm tunnel/bridge portion, respectively Further, the pillow is configured such that the tunnel/bridge section connecting the head support pillow section to the body support section is positioned at an angle such that the side facing the user is positioned further from the outer end of the head support pillow section than is the side facing away from the user.

BRIEF DESCRIPTION OF THE DRAWINGS

A more complete appreciation of the invention and the many aspects and advantages thereof will become readily apparent by reference to the following detailed description when considered in conjunction with the accompanying drawings wherein.

DETAILED DESCRIPTION OF THE INVENTION

Figure 1:
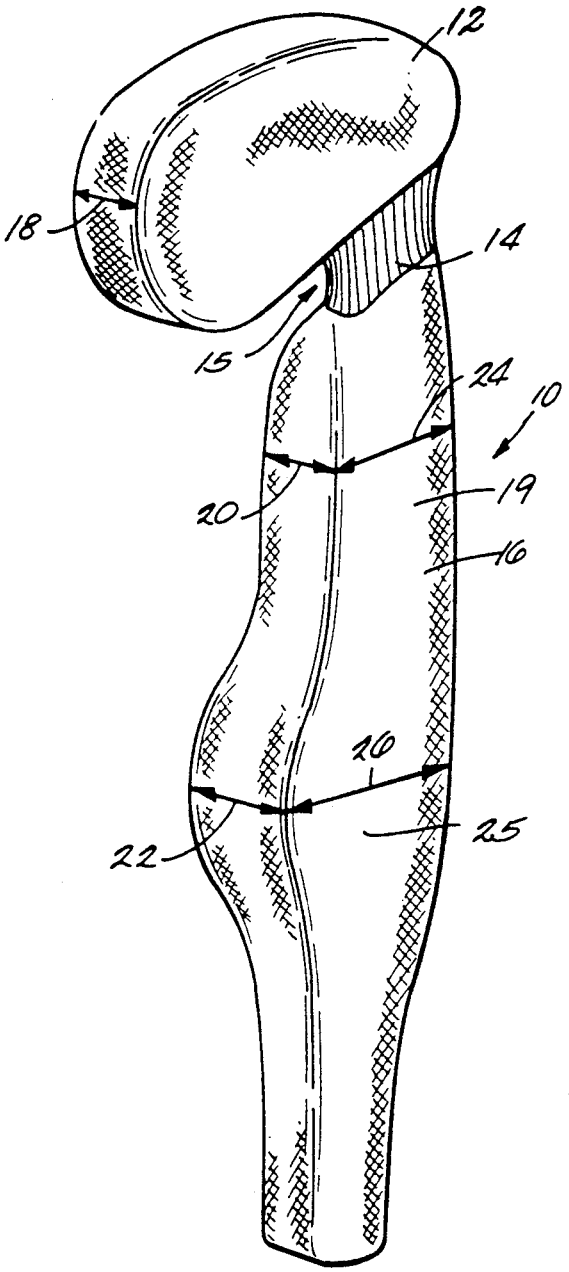
FIG. 1 is a perspective view of a pillow of the present invention.
Figure 2:
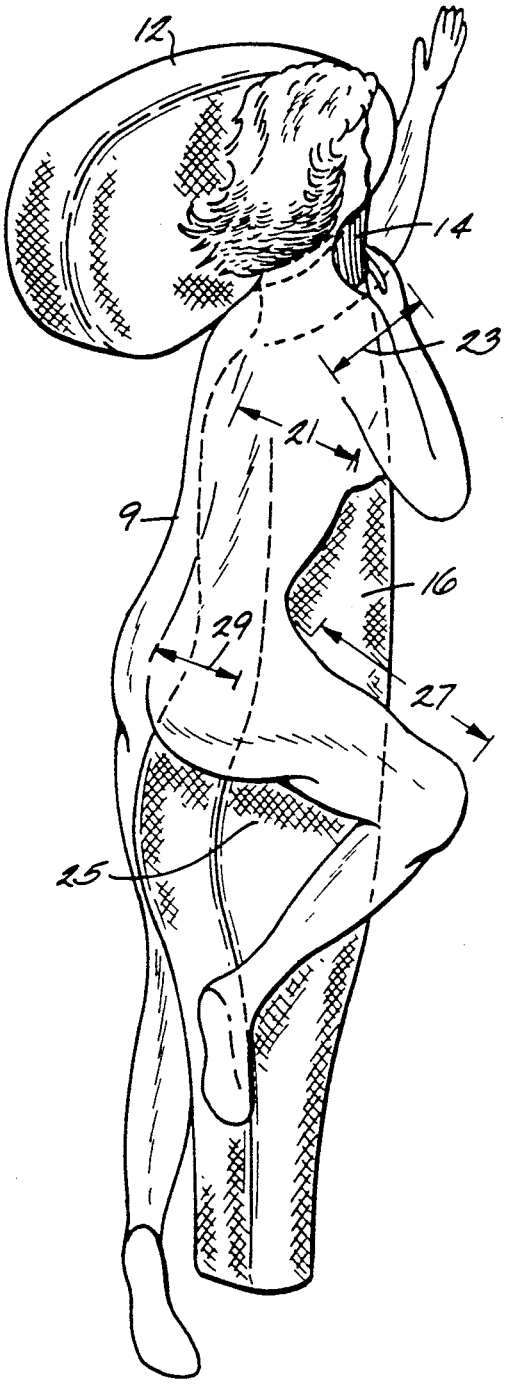
FIG. 2 is a perspective view of a pillow of this invention in conjunction with the body of a user with hidden parts shown by means of dotted lines.
Figure 3:
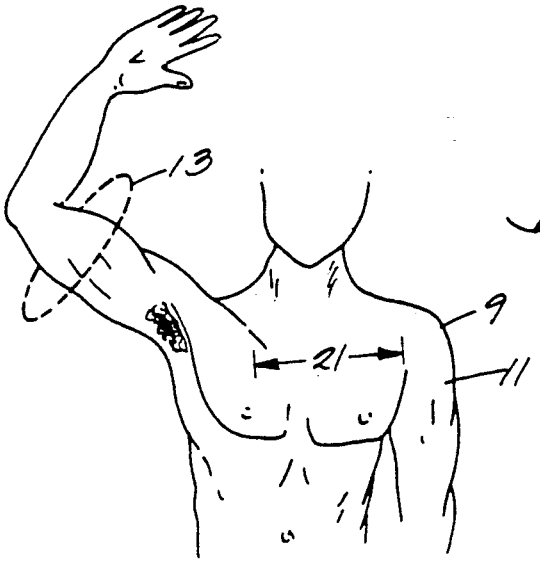
FIG. 3 is a partial frontal view of a user of a pillow of this invention.
Figure 4:
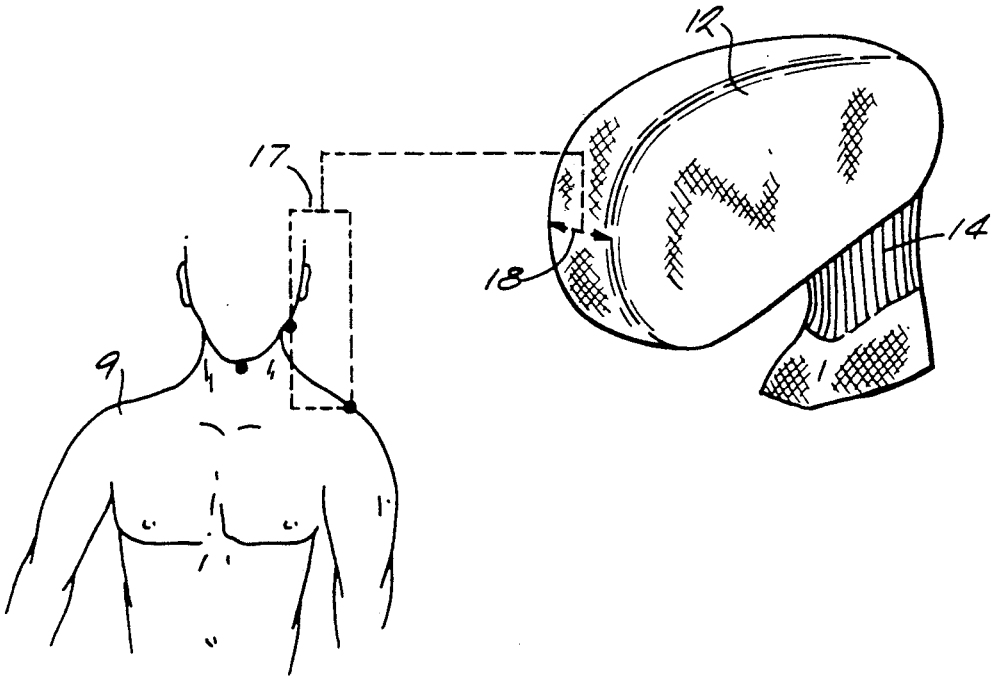
FIG. 4 is another partial frontal view of the user of the pillow of this invention with a broken away perspective view of the upper end of a pillow of this invention.

As seen in the drawing, a skeletal support pillow 10 includes a head support pillow section 12 and arm tunnel/bridge section 14 and a body support section 16. Head support section 12 is of the size sufficient to facilitate comfortable sleeping and has a thickness 18 approximately equal to the distance 17 between the acromial-clavicular joint to the ipsilateral angle of the jaw of the user 9. This distance can also be described as the distance from the auxiliary fold or underarm to the ipsilateral angle of the jaw. The head rest platform 12 and body rest platform 16 are so connected as to leave a shoulder notch 15 adjacent one side of tunnel bridge section 14. The diameter of the tunnel bridge is determined by the circumference 13 of the upper arm, i.e.

biceps and triceps of the user 9. Shoulder notch 15 should be at least equal in width to the width of the deltoid muscle at its widest point. Tunnel bridge section is attached at one side to the base of the head support pillow section 12 and at its opposite end to the upper end of body support section 16.

The body support section has an upper body support portion 19 which has a thickness 20 approximately equal to the distance 21 between the user's axillary fold and the contralateral nipple. Portion 19 is also alternatively referred to as the chest resting platform. The body support portion 16 also has a widened section for support of the lower limbs which can also be characterized as a thigh resting platform 25. Chest resting platform 19 has a width 24 equal approximately to the distance 23 between the user's anterior chest and elbow with arm extended. This distance 24 could alternately be described as the length of the humerus minus one-half the thickness of the chest. The thigh resting platform 25 should have a width equal to the length of the femur 27. That width provides a comfortable platform in which knee and hip may be flexed or extended in order to provide comfortable alternate resting positions. The thickness 22 of the thigh resting platform should be approximately equal to the distance 29 between the lateral aspect of the great trochanter to the contralateral anterior superior iliac spine.

The pillow should have an overall length approximately equal to the distance between the top of the user's head and mid calf. While not critical, the length of the user's foot provides a good approximation of the distance from the shoulder notch to the center of the head platform while the circumference of the user's chest at approximately the level of the fifth rib provides a guide for the general shape and circumference for the head resting platform.

It will be appreciated that the pillow is functional as described It may further be enhanced with an assortment of internal devices. Specifically, several input or output devices (in line with an assortment of computer chips) can be used to organize an orderly response to a series of pre-programmed set of conditions in accordance with a prescribed healthcare program for the user.

Hence, the pillow of the present invention is custom fitted to the skeletal dimensions of the user and can be used to provide the least stressful positions for the musculoskeletal system. This is accomplished in many instances by allowing spastic muscles to contract and shorten while lengthening other non-spastic muscles. The injured or post surgical patient may need to shift body weight without significant changes in anatomical orientations, from time to time, during sleep. Since the pillow does not change and therefore remains in a constant position it is able to assist a light sleeper during critical rest periods such as while traveling Among those benefitted are professional athletes, who may encounter excessive musculoskeletal stress, construction workers, or truck drivers. Particularly, the pillow device of the present invention enables a person who has undergone orthopedic implant surgery the option of an immediate side sleeping position which would not otherwise be possible.

While a preferred shape and design for the pillow of the present invention has been illustrated herein, it will be appreciated that various modifications can be made by those skilled in the art without departing from the spirit of the invention. Thus, the invention should be construed as embracing the novel concepts of the pillow disclosed herein but limited solely by the scope of the appended claims.

What is claimed is:

1. A skeletal support pillow conforming to the bodily skeletal dimensions of a user comprising:

a head support pillow section having a thickness approximately equal to the distance between the acromial clavicular joint to the ipsilateral angle of the jaw of the user, an arm tunnel/bridge section attached at one side to the base of said head support pillow section, said tunnel having a diameter slightly greater than the maximum diameter of the user's upper arm measured at the level of the mid-biceps, a body support section attached to the opposite side of the arm tunnel/bridge section, said body support section having an upper body support portion having a thickness approximately equal to the distance between opposite axillary folds of the user's body, and a lower limb support section approximately equal in thickness to the distance between the lateral aspect of the user's greater trochanter and the contralateral anterior superior iliac spine, the upper body support section having a width approximately equal to the distance between the user's anterior chest and elbow, with arm extended, and the lower limb supporting section having a width approximately equal to the length of the user's femur.

2. A support pillow according to claim 1 wherein a notch is provided on one side of said pillow adjacent the tunnel/bridge section to accommodate one of the user's shoulders.

3. A support pillow according to claim 1 wherein the width of the body support section is centrally widened and tapered toward the narrower distal end and arm tunnel/bridge portion, respectively.

4. A support pillow according to claim 1 wherein the tunnel/bridge section is positioned at an angle such that the side facing the user is positioned further from the outer end of the head support pillow section than is the side facing away from the user.

* * * * *